US006012956A

United States Patent [19]

Mishima et al.

[11] Patent Number: 6,012,956

[45] Date of Patent: Jan. 11, 2000

[54] COOLING WATER PASSAGE STRUCTURE OF OUTBOARD MOTOR

[75] Inventors: Shuichi Mishima, Iwata; Toshio Watanabe; Hidetsugu Shimada, both of Hamamatsu; Katsuhiro Fukuda, Shizuoka-ken; Jun Itoh, Hamamatsu; Satoru Takahashi, Hamamatsu; Shuichi Hagino, Hamamatsu, all of Japan

[73] Assignee: Suzuki Kabushiki Kaisha, Hamamatsu, Japan

[21] Appl. No.: 09/094,034

[22] Filed: Jun. 9, 1998

[30] Foreign Application Priority Data

Jun. 10, 1997 [JP] Japan ..... 9-152433

[51] Int. Cl.[7] ..... B63H 21/10

[52] U.S. Cl. ..... 440/88; 440/900; 123/41.09

[58] Field of Search ..... 440/1, 2, 88, 89, 440/900; 123/41.09, 195 P, 195 W

[56] References Cited

U.S. PATENT DOCUMENTS

| | | | |
|---|---|---|---|
| 4,669,988 | 6/1987 | Breckenfeld et al. | 440/88 |
| 5,330,376 | 7/1994 | Okumura | 440/88 |
| 5,487,688 | 1/1996 | Sumigawa | 440/88 |
| 5,715,777 | 2/1998 | Wada et al. | 440/88 |
| 5,876,256 | 3/1999 | Takahashi et al. | 440/88 |

FOREIGN PATENT DOCUMENTS 8-100658 4/1996 Japan .

*Primary Examiner*—Stephen Avila

*Attorney, Agent, or Firm*—Finnegan, Henderson, Farabow, Garrett & Dunner, L.L.P.

[57] ABSTRACT

An outboard motor is equipped with an engine, an engine holder, an oil pan disposed below the engine in a state of the outboard motor being mounted to a hull, a water pump disposed below the oil pan, and a cooling water passage structure. The cooling water passage structure includes a vertical cooling water passage vertically passing through inside the oil pan and communicated with the side of the engine, a lateral cooling water passage extending in a lateral direction along a bottom surface of the oil pan, a cooling water supply pipe extending upward from the water pump and connected to a side of the engine, and a water pressure relief valve provided for the lateral cooling water passage for controlling a pressure increasing of the cooling water. The lateral cooling water passage has one end communicated with a lower end of the vertical cooling water passage and has another one end to which an upper end of the cooling water supply pipe is connected.

6 Claims, 6 Drawing Sheets

COOLING WATER PASSAGE STRUCTURE OF OUTBOARD MOTOR

BACKGROUND OF THE INVENTION

The present invention relates to a cooling water passage structure of an outboard motor.

In general, an outboard motor is equipped with an engine vertically disposed on the uppermost portion of the outboard motor in a state mounted to a hull (boat body), for example. That is, a crankshaft is mounted so as to stand upright, and an output (power) of the engine is transmitted to a propeller through a drive shaft which largely extends downward from the engine. When the engine is a four-stroke-cycle engine, an oil pan is disposed below the engine, and oil accumulated in the oil pan is pumped up by an oil pump and is supplied to the engine, thereby lubricating inside the engine.

Further, an engine of the outboard motor is a water-cooled engine and is provided with a water pump for introducing, into the engine, sea water, lake water or river water as cooling water, and the water pump is disposed below the oil pan and is located in the vicinity of the surface of the water. The water pump is driven by the engine through the rotation of the drive shaft.

For example, Japanese Patent Laid-open Publication No. HEI 8-100658 discloses an outboard motor in which a cooling water supply pipe is extending upward from the water pump and is connected to a cooling water passage in an engine. When the water pump is driven through the rotation of a drive shaft for the engine, water discharged from the water pump is supplied through the cooling water supply pipe to the engine to cool the engine.

Further, a water pressure valve is provided in the cooling water passage in the engine. When the cooling water temperature is still low such as immediately after the start of the engine operation, a thermostat provided in the engine operates to stop the flow of the cooling water for facilitating the warm-up of the engine, which increases the pressure of the cooling water. The water pressure valve serves as a relief valve for preventing an excessive pressure rise by discharging a portion of the cooling water so as to protect a sealing portion of the cooling water passage.

In the conventional outboard motor, the water pressure valve is provided in the cooling water passage in the engine (see Japanese Patent Application Laid-open No. HEI 8-100658).

However, because the water pressure valve is provided in the engine itself, layouts of other parts provided in the engine are limited. Further, it is necessary to provide an exclusive passage or pipe member for flowing cooling drainage discharged from the water pressure valve, which causes a problem that a space in the engine room is reduced, and the structure is made complicated.

Furthermore, since there is no special cooling means for the oil accumulated in the oil pan, there is another problem that the temperature of oil is prone to be increased when the outboard motor is driven at high load.

SUMMARY OF THE INVENTION

A primary object of the present invention is to substantially eliminate defects or drawbacks encountered in the prior art mentioned above and to provide a cooling water passage structure of an outboard motor capable of disposing a water pressure valve without limiting the layout of engine parts, to simplify the structure of the outboard motor and to effectively cool an oil accumulated in an oil pan.

Another object of the present invention is to provide a cooling water passage structure of an outboard motor capable of disposing the cooling water passage in the oil pan without reducing the amount of oil accumulated in the oil pan and without lowering the manufacturing performance of the oil pan.

A further object of the present invention is to provide a cooling water passage structure of an outboard motor capable of simplifying the peripheral structure of the cooling water passage disposed in the oil pan, thereby facilitating the assembling operation.

These and other objects of the present invention can be achieved by providing a cooling water passage structure of an outboard motor which is equipped with an engine, an engine holder, an oil pan disposed below the engine in a state of the outboard motor mounted to a hull and a water pump disposed below the oil pan, the cooling water passage structure comprising:

- a vertical cooling water passage vertically passing through inside the oil pan and communicated with a side of the engine;
- a lateral cooling water passage extending in a lateral direction along a bottom surface of the oil pan;
- a cooling water supply pipe extending upward from the water pump and connected to the side of the engine; and
- a water pressure valve provided for the lateral cooling water passage for controlling a pressure increasing of the cooling water,
- wherein the lateral cooling water passage has one end communicated with a lower end of the vertical cooling water passage and has another one end to which an upper end of the cooling water supply pipe is connected.

In a preferred embodiment, there is further provided with a bottomed box-shaped passage case having an opened upper end and liquid-tightly secured to the bottom surface of the oil pan from a lower side thereof and an interior of the passage case is formed as the lateral cooling water passage. The cooling water supply pipe has an upper end connected to the passage case and the passage case is provided with the water pressure valve.

A communication recess is formed to the bottom surface of the oil pan so that one end of the lateral cooling water passage is communicated with the lower end of the vertical cooling water passage and the water pressure valve is disposed below the communication recess.

The vertical cooling water passage is composed of passage sections passing through the oil pan and the engine holder and being aligned together. The engine holder and the oil pan are formed with cooling water discharge passages formed integrally for discharging outward the cooling water from the engine.

According to the characteristic features of the present invention mentioned above, the cooling water discharged from the water pump is supplied into the engine through the lateral cooling water passage and the vertical cooling water passage provided in the oil pan. At that time, the oil accumulated in the oil pan is effectively cooled by the cooling water passing through the lateral cooling water passage and the vertical cooling water passage.

Furthermore, since the water pressure valve is provided in the lateral cooling water passage formed in the oil pan, the water pressure valve can be disposed without deteriorating the layout of the engine parts. Moreover, since the cooling water discharged from the water pressure valve can be flowed into the exhaust gas expansion chamber as it is, it is unnecessary to provide an exclusive passage or pipe member for flowing the cooling drainage and the structure of the outboard motor can be simplified.

The lateral cooling water passage is formed lower than the bottom surface of the oil pan, so that a volume of the oil pan is not reduced even though the lateral cooling water passage is disposed. Furthermore, since the lateral cooling water passage is formed in the passage case which is separated from the bottom surface of the oil pan, it is not necessary to use a complicated molding die for the oil pan. Therefore, the lateral cooling water passage can easily be disposed without deteriorating the producing performance of the oil pan.

Still furthermore, since the upper end of the cooling water supply pipe and the water pressure valve are not mounted on the oil pan itself, it is possible to simplify a structure around the cooling water passage which is to be disposed in the oil pan, and the assembling performance is hence enhanced.

The nature and further characteristic features of the present invention will be made more clear from the following descriptions made with reference to the accompanying drawings.

DESCRIPTION OF THE PREFERRED EMBODIMENT

Figure 1:
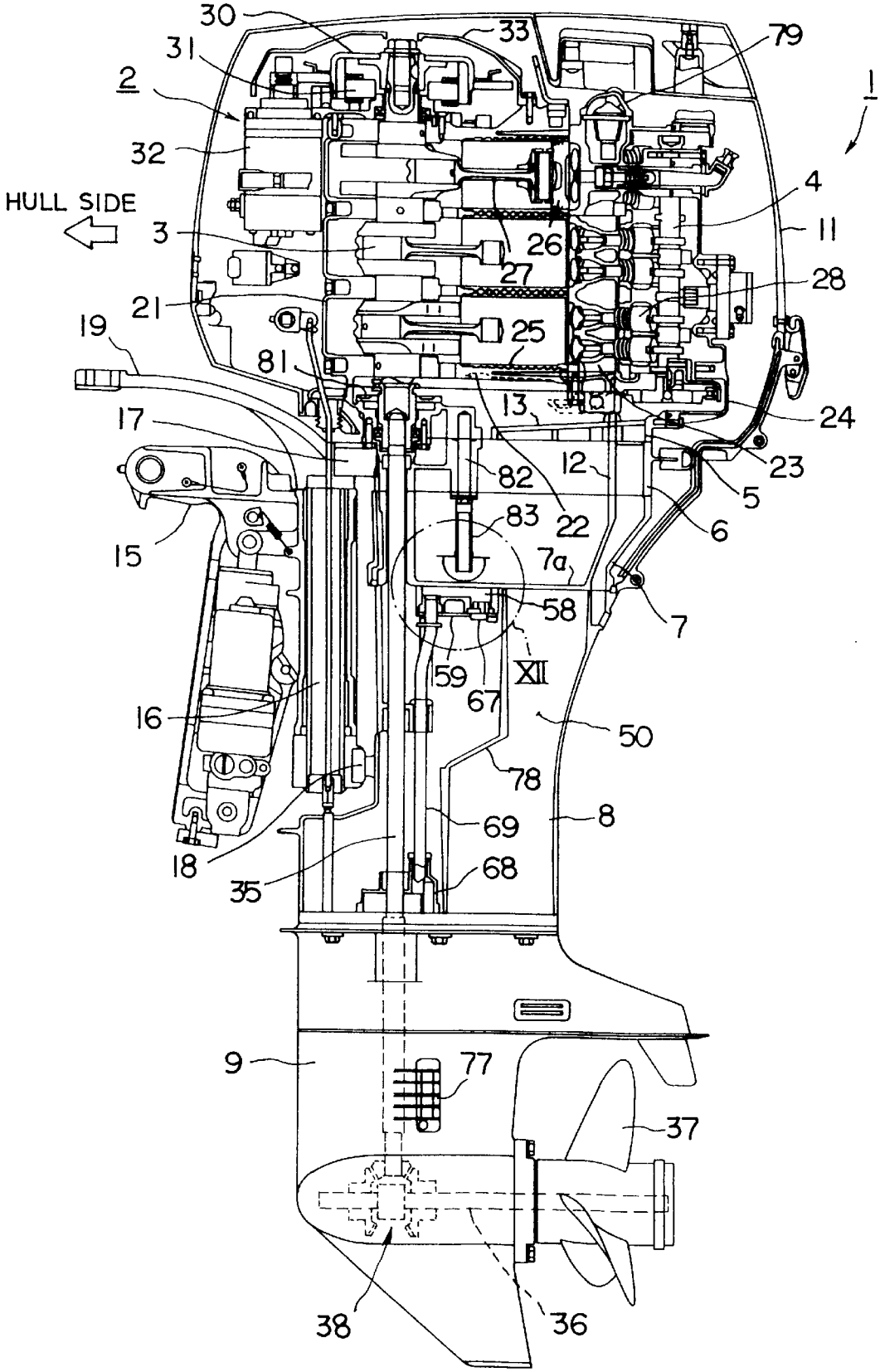
FIG. 1 is a longitudinal left sectional view of an outboard motor to which one embodiment of a cooling structure according to the present invention is applied.
Figure 2:
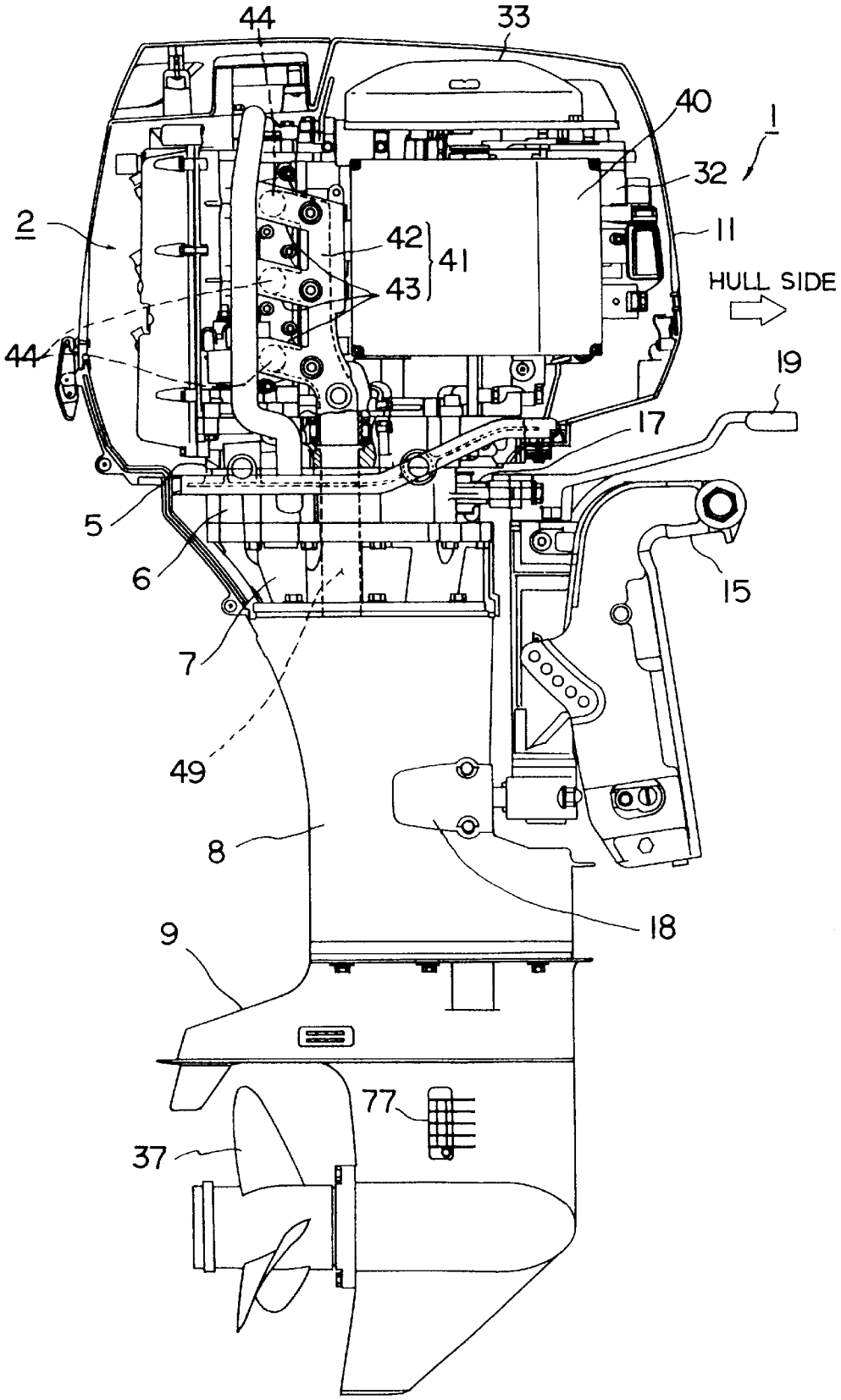
FIG. 2 is a right side view of the outboard motor.

With reference to FIGS. 1 and 2, a preferred embodiment of the present invention will be described hereunder.

An engine 2 of an outboard motor 1 is a four-stroke-cycle three-cylinder water-cooled gasoline engine in which a crankshaft 3 and a camshaft 4 are vertically disposed uprightly in a state of the outboard motor mounted to a hull (boat body), for example. A chain case 5 is disposed below the engine 2 and an engine holder 6 is fixed below the chain case 5. An oil pan 7, a drive shaft housing 8 and the gear housing 9 are fixed in this order below the engine holder 6. The engine 2 is entirely covered with a detachable engine cover 11.

Figure 3:
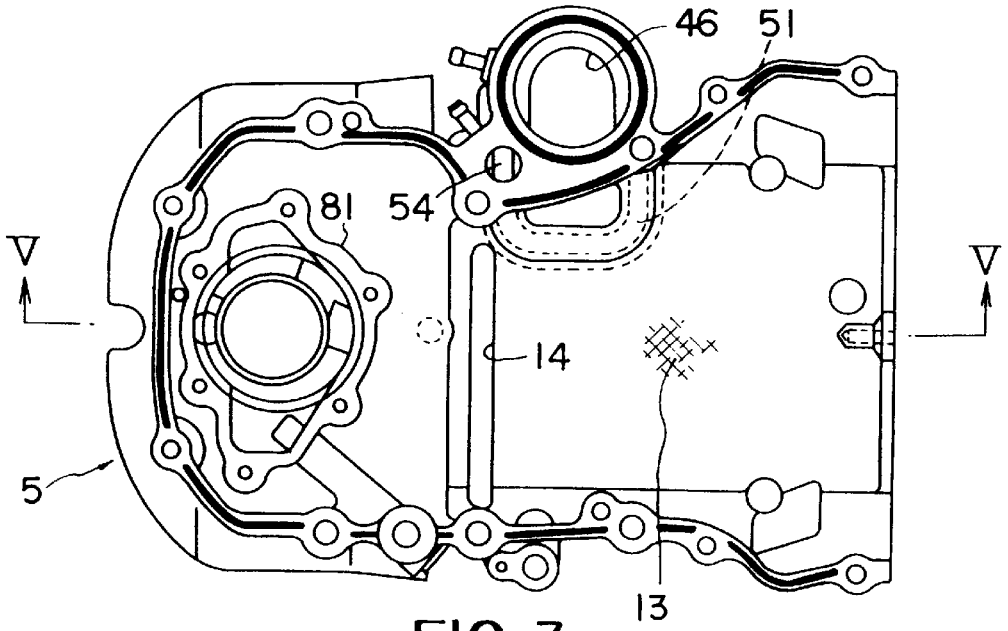
FIG. 3 is a top view of a chain case of the outboard motor.
Figure 4:
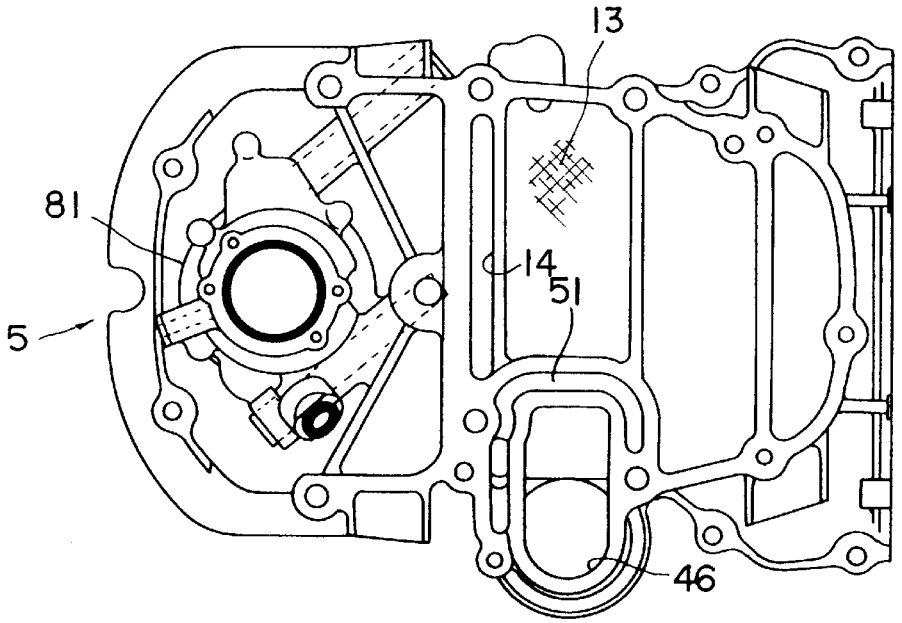
FIG. 4 is a bottom view of the chain case.
Figure 5:
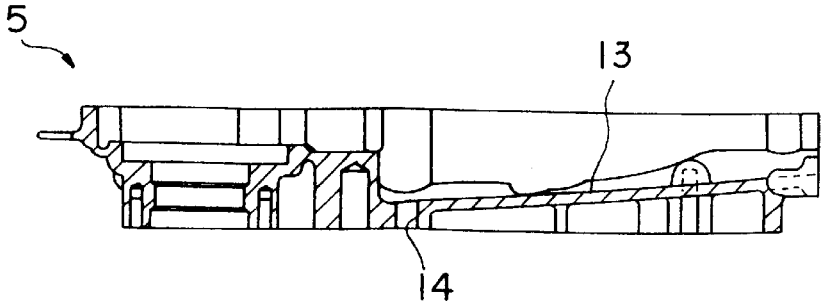
FIG. 5 is a longitudinal sectional view of the chain case taken along the line V—V in FIG. 3.
Figure 6:
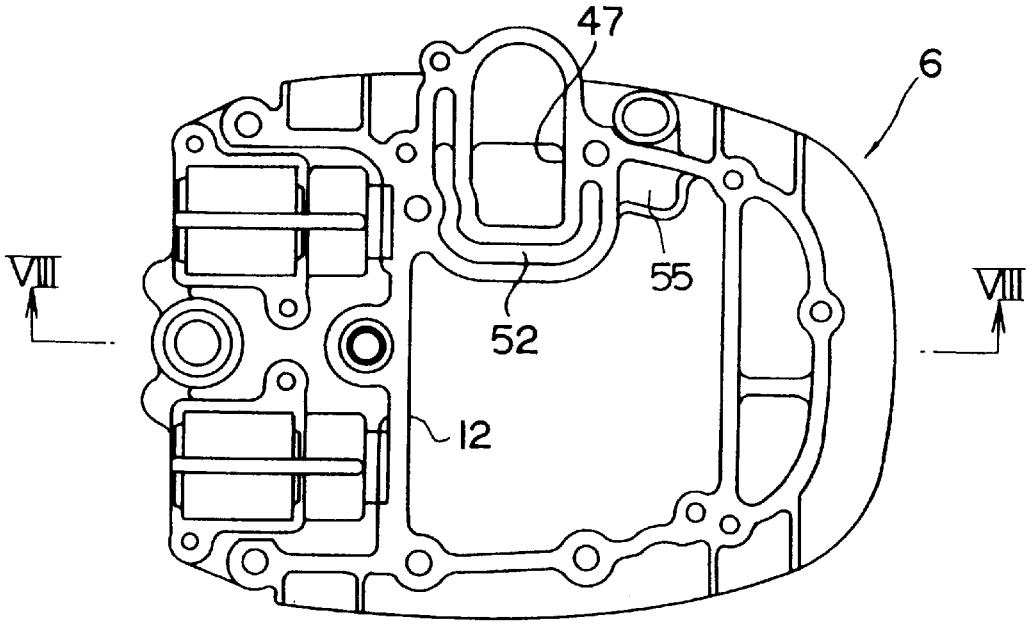
FIG. 6 is a top view of an engine holder of the outboard motor.
Figure 7:
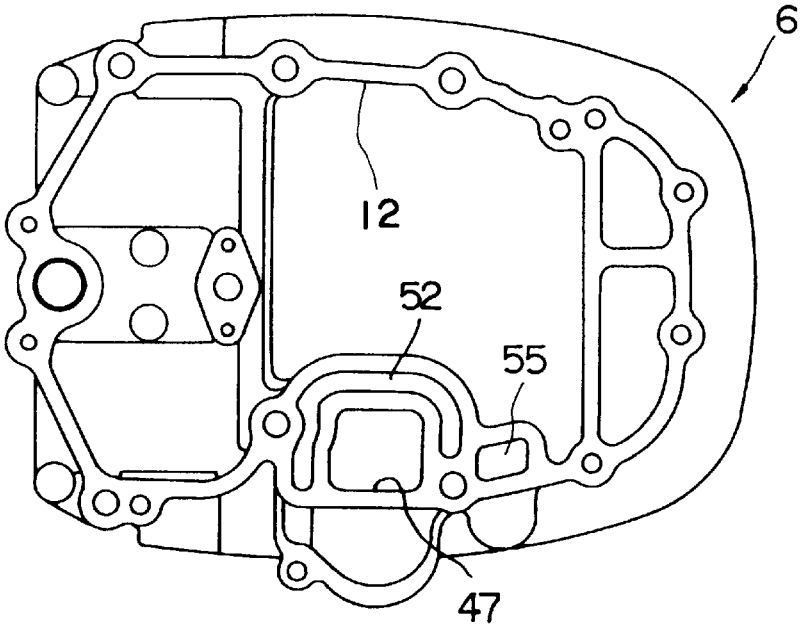
FIG. 7 is a bottom view of the engine holder.
Figure 8:
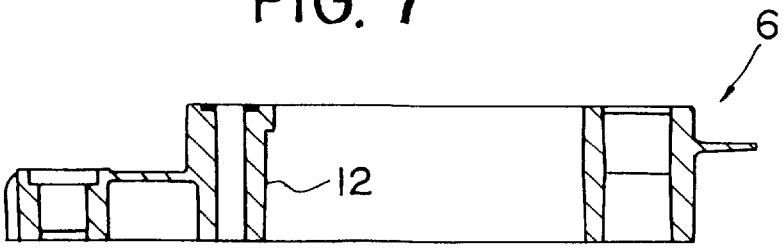
FIG. 8 is a longitudinal sectional view of the engine holder taken along the line VIII—VIII in FIG. 6.
Figure 9:
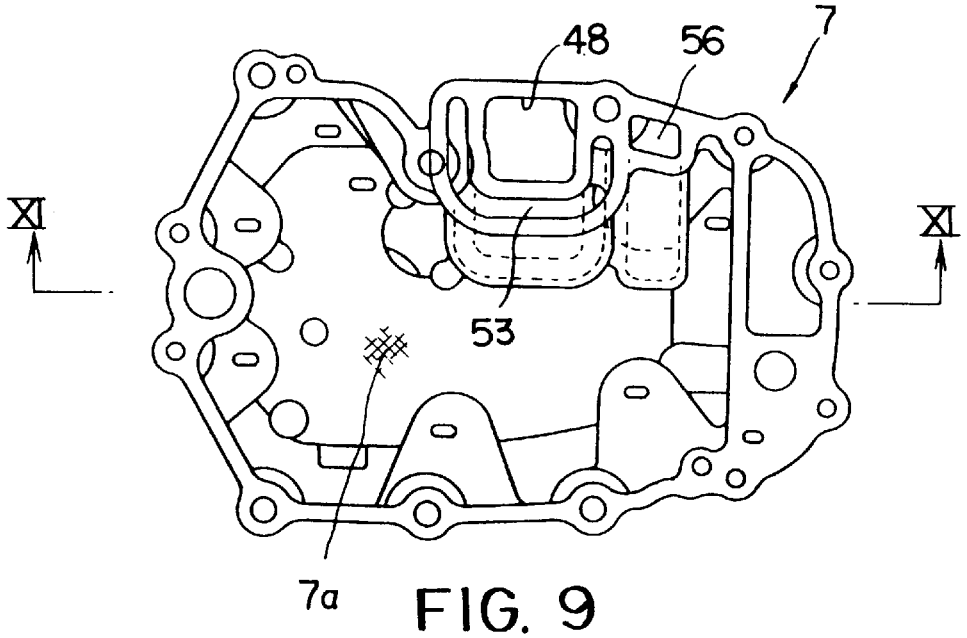
FIG. 9 is a top view of an oil pan of the outboard motor.
Figure 10:
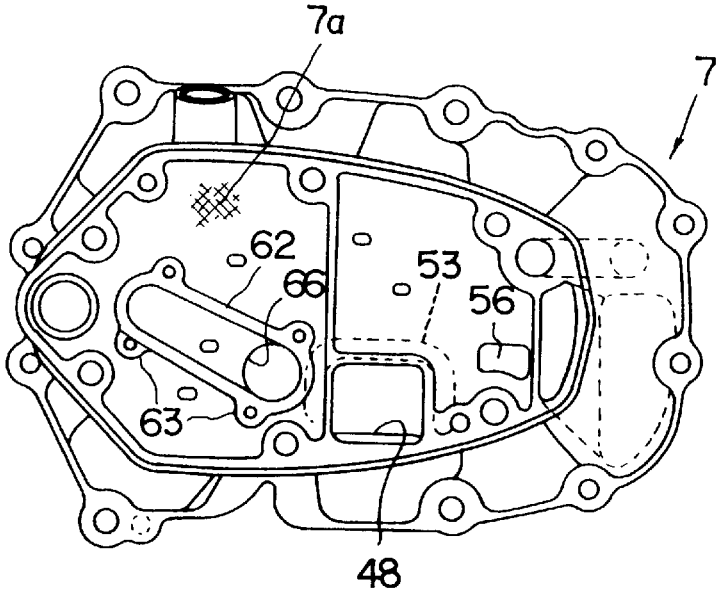
FIG. 10 is a bottom view of the oil pan.
Figure 11:
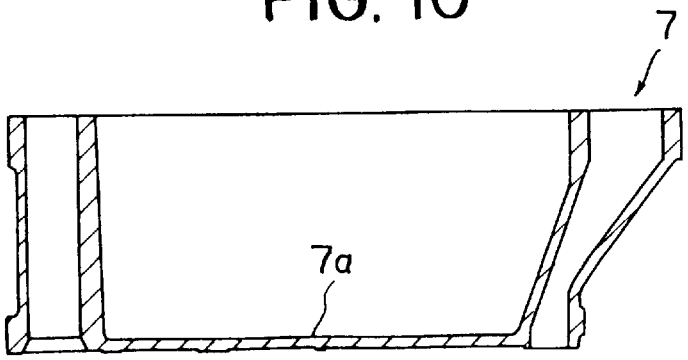
FIG. 11 is a longitudinal sectional view of the oil pan taken along the line XI—XI in FIG. 9.

FIGS. 3 to 5 show the chain case 5, FIGS. 6 to 8 show the engine holder 6 and FIGS. 9 to 11 show the oil pan 7. The oil pan 7 is formed into a bottomed deep container shape. Each of the chain case 5 and the engine holder 6 is formed into substantially flat plate shape and is designed to be liquid-tightly superposed on the oil pan 7. The engine holder 6 is formed at its center portion with a substantially square hole 12 which is in communication with an interior of the oil pan 7. The chain case 5 is formed into a tray shape having a partitioning surface 13 which is slightly inclined, and is formed at its center portion with a thin slit 14 extending in a widthwise direction of a vehicle.

The outboard motor 1 is provided a clamp bracket 15 fixed to a boat body (stern plate) which is not shown, and a pilot shaft 15 is rotatably pivoted in a vertical direction at a rear portion of the clamp bracket 15. Mount portions 17 and 18 respectively mounted to the engine holder 6 and the drive shaft housing 8 are respectively connected to upper and lower ends of the pilot shaft 16 to be turnable together. Therefore, the outboard motor 1 is held such that it can be steered into left and right directions with respect to the boat body around the pilot shaft 16 as an axis. A steering arm 19 for steering the outboard motor 1 is mounted to the pilot shaft 16 to be turnable together.

The engine 2 is assembled such that a crankcase 21, a cylinder block 22, a cylinder head 23, a head cover 24 and the like are connected in this order from the front side. The crankshaft 3 is pivoted between the crankcase 21 and the cylinder block 22, and the camshaft 4 is pivoted in the cylinder head 23. Three cylinders 25 are formed in a horizontal direction in the cylinder block 22 and pistons 26 inserted in the cylinders 25 are connected to the crankshaft 3 through connecting rods 27.

A valve operating device 28 is accommodated in each of the cylinder head 23. Rotation of the crankshaft 3 is transmitted to the camshaft 4 through a chain mechanism (not shown) incorporated in the chain case 5, and the valve operating device 28 is driven through the rotation of the camshaft 4.

An upper end of the crankshaft 3 is projected to an upper surface of the engine 2 and is provided with a flywheel 30 to be rotatable together and also provided with a generator 31 for generating electricity. Further, a starter motor 32 for starting the engine 2 is disposed on a front surface of the engine 2. The flywheel 30, the generator 31, the starter motor 32 and the like are covered from the upper sides thereof with a cover member 33 made of synthetic resin, for example.

A drive shaft 35, which is disposed in the drive shaft housing 8, largely extending downward is connected to a lower end of the crankshaft 3. The drive shaft 35 is extended into the gear housing 9 through the engine holder 6, the oil pan 7 and the drive shaft housing 8. A propeller shaft 36 extending longitudinally is pivotally supported in the gear housing 9 and is provided with a propeller 37 to be rotatable together. The rotation of the drive shaft 35, i.e., of the crankshaft 3, is transmitted to the propeller shaft 36 through a bevel gear mechanism 38 provided at a point of intersection of the drive shaft 35 and the propeller shaft 36 so that the propeller 37 is rotated to provide impellent.

As shown in FIG. 2, an electric equipment box 40 and an exhaust manifold 41 are disposed on a right side of the engine 2. The exhaust manifold 41 is provided with a single manifold pipe 42 extending in a vertical direction, and three manifold branches 43 diverging from the manifold pipe 42. The manifold branches 43 are connected to each of three exhaust ports 44 which are opened at a right side of the cylinder head 23.

Exhaust passages 46, 47 and 48 are formed in right edges of the chain case 5, the engine holder 6 and the oil pan 7, respectively. The exhaust passages 46, 47 and 48 are aligned by superposing the chain case 5, the engine holder 6 and the oil pan 7 so as to form a vertically extending exhaust passage structure 49 as shown in FIG. 2. A lower end of the manifold pipe 42 of the exhaust manifold 41 is inserted into the exhaust passage 46 of the chain case 5 from the upper side thereof.

Therefore, the exhaust gas from the engine 2 is discharged from the exhaust manifold 41 through the exhaust passages 46, 47 and 48 (exhaust passage structure 49) into an exhaust gas expansion chamber 50. The exhaust gas is expanded in the exhaust gas expansion chamber 50 and then discharged into water through the gear housing 9 and an exhaust passage (not shown) formed in a center portion of the propeller 37.

Vertical cooling water passages 51, 52 and 53 are formed in the chain case 5, the engine holder 6 and the oil pan 7, respectively. These vertical cooling water passages 51, 52 and 53 are formed into U-shape in a manner such that they respectively pass through the chain case 5, the engine holder 6 and the oil pan 7 and that they surround the exhaust passages 46, 47 and 48. The vertical cooling water passages 51, 52 and 53 are aligned with one another to form a single cooling water passage structure extending in a vertical direction.

A circular small hole 54 is formed in an upper end of the vertical cooling water passage 51 of the chain case 5, the upper end being closed except the circular small hole 54, and the small hole 54 is aligned with a cooling water supply hole (not shown) which is opened at a lower surface of the engine 2.

The engine holder 6 and the oil pan 7 are integrally provided with cooling water discharging passages 55 and 56, respectively, which are the passages for downwardly flowing the cooling water discharged from the engine 2 and then discharging the cooling water outside.

Figure 12:
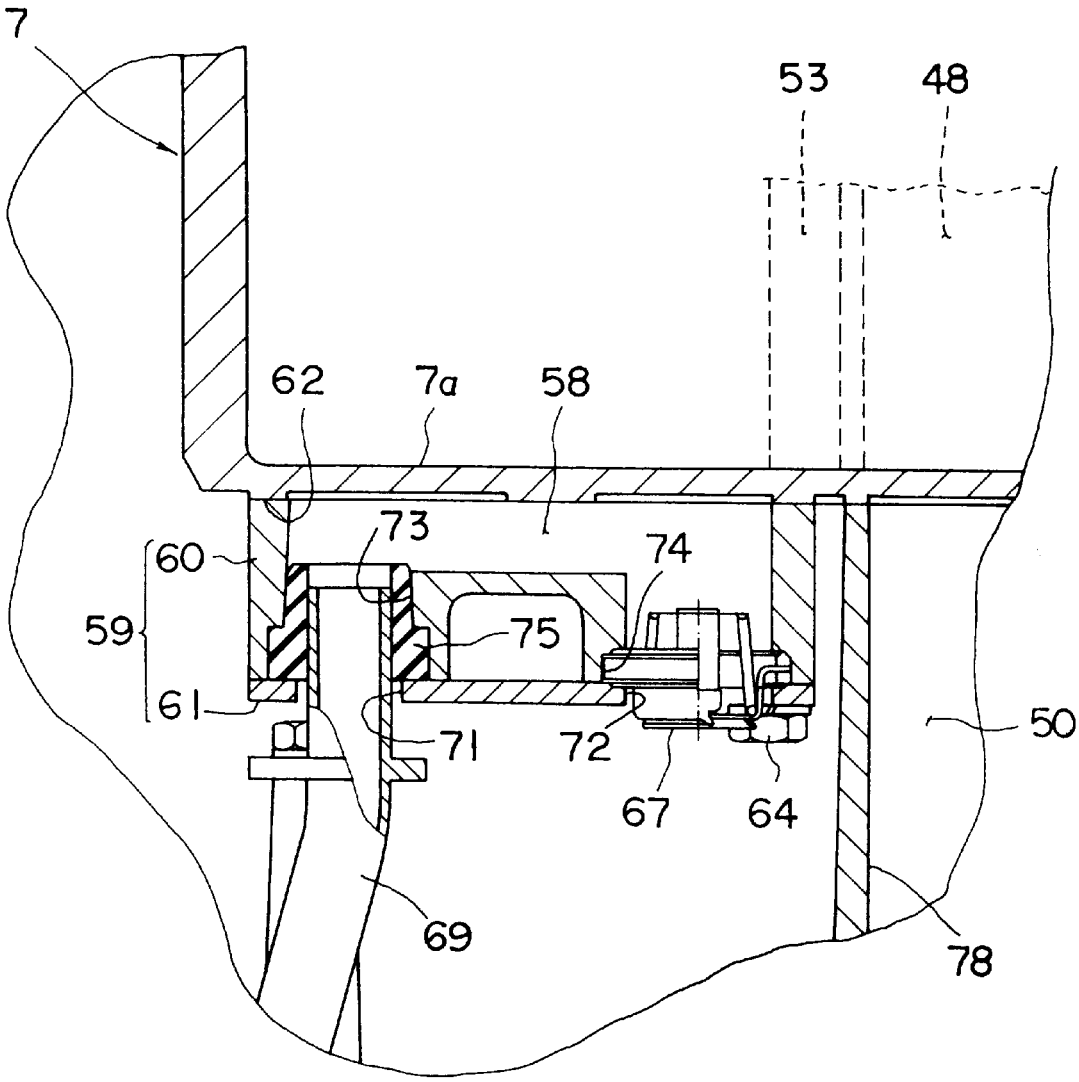
FIG. 12 is an enlarged view of the portion XII in FIG. 1 for showing one embodiment of the present invention.

Further, a lateral cooling water passage 58 is formed so as to extend in a lateral direction along a bottom surface 7*a* of the oil pan 7. As shown in FIG. 12, a bottomed passage case 59 having an opened upper end is liquid-tightly secured to a bottom surface 7*a* of the oil pan 7, and an interior of the passage case 59 constitutes the lateral cooling water passage 58. The passage case 59 comprises a case intermediate member 60 and a case bottom member 61.

As also shown in FIG. 10, an elliptical passage case mount seating face 62 is formed on the under side of the bottom surface 71 of the oil pan 7, and four fastening bosses 63 are provided around the elliptical passage case mount seating face 62. The case intermediate member 60 and the case bottom member 61 of the passage case 59 are placed in this order on the under side of the passage case mount seating surface 62. The case intermediate member 60 and the case bottom member 61 are fastened to the fastening bosses 63 together by means of four bolts 64 (see FIG. 12) inserted from the lower side of the case bottom member 61.

The bottom surface 7*a* of the oil pan 7 is provided with a communication recess 66 (see FIG. 10) so that one end (e.g., rear end) of the lateral cooling water passage 58 is brought into communication with the lower end of the vertical cooling water passage 53. A water pressure valve 67 is disposed below the communication recess 66. Further, as shown in FIG. 1, a water pump 68 is disposed below the oil pan 7, e.g., above the gear housing 9. A cooling water supply pipe 69 extending upward from the water pump 68 is connected to the other end (e.g., front end) of the lateral cooling water passage 58.

More specifically, through holes 71 and 72 are respectively formed in opposite ends of the case bottom member 61 which is a bottom surface of the passage case 59. Stepped holes 73 and 74 are formed in the case intermediate member 60 at its portions aligned with the through holes 71 and 72. An upper end of the cooling water supply pipe 69 is press-fitted into the front stepped hole 73 through a rubber grommet 75, and the water pressure valve 67 is fitted into the rear stepped hole 74, so that the grommet 75 and the water pressure valve 67 are pressed and held by the case bottom member 61.

The water pump 68 is designed so as to be driven by the drive shaft 35, and a drawing side of the water pump 68 is connected to a cooling water drawing port 77 formed in opposite sides of the gear housing 9. When the engine 2 is started and the drive shaft 35 is rotated, the water pump 68 is driven to pump up the outside water from the cooling water drawing port 77. The pumped water passes from the cooling water supply pipe 69 through the lateral cooling water passage 58 and the vertical cooling water passage 53, and then, flows into the engine 2 for cooling the latter through the chain case 5 and the vertical cooling water passages 51 and 52 of the engine holder 6.

An inner space of the drive shaft housing 8 is partitioned into front and rear two chambers by a partition wall 78. The drive shaft 35, the water pump 68, the cooling water supply pipe 69 and the like are disposed in the front chamber, and the rear chamber constitutes the exhaust gas expansion chamber 50 mentioned hereinbefore. Therefore, a high-temperature exhaust gas flowing in the exhaust gas expansion chamber 50 does not directly contact the water pump 68 and the cooling water supply pipe 69, which prevents a temperature rise of the cooling water and a deterioration in quality of material constituting each of the various members.

When a temperature of the cooling water is still low such as immediately after the start of the engine 2, a thermostat valve 79 (see FIG. 1) provided in the engine 2 serves to stop the flow of the cooling water to facilitate the warm-up of the engine 2. Therefore, a pressure of the cooling water in the cooling water path downstream of the water pump 68 is increased to open the water pressure valve 67 and thus, a portion of the cooling water is discharged outside, thereby preventing an excessive pressure rise. The discharged cooling water is flowed into the exhaust gas expansion chamber 50 as it is.

As shown in FIG. 1, the chain case 5 is provided at its upper surface with an oil pump 81, which is of a trochoid type, which is driven directly by the crankshaft 3, for example, and a lower end of an oil strainer 83 connected to a suction passage 82 of the oil pump 81 is hung down to a portion in the vicinity of a bottom of the oil pan 7. Oil is accumulated in the oil pan 7, and when the oil pump 81 is driven, the oil is pumped up from the oil strainer 83 and is supplied into the engine 2. After the inside of the engine 2 is lubricated by the oil, the oil is dropped on the partitioning surface 13 of the chain case 5 and is returned into the oil pan 7 from the slit 14.

According to the cooling water passage structure of the outboard motor 1 constituted as described above, since the cooling water discharged from the water pump 68 is supplied into the engine 2 through the lateral cooling water passage 58 and the vertical cooling water passage 53 provided in the oil pan 7, the oil accumulated in the oil pan 7 is effectively cooled by the cooling water passing through the lateral cooling water passage 58 and the vertical cooling water passage 53. Therefore, even when the outboard motor 1 is driven under a high load, it is possible to keep lubricating the engine 2 excellently.

Further, since the lateral cooling water passage 58 is provided with the water pressure valve 67, the water pressure valve 67 can be disposed without deteriorating the layout of other parts provided in the engine 2, as compared with a case in which the water pressure valve is provided in the engine itself as in the conventional outboard motor. Furthermore, since the cooling water discharged from the water pressure valve 67 can flow into the exhaust gas expansion chamber 50 as it is, it is unnecessary to provide an exclusive passage or pipe member for flowing the cooling drainage, and hence, the structure of the outboard motor 1 can be simplified.

The lateral cooling water passage 58 is provided so as to project lower than the bottom surface 7*a* of the oil pan 7, a volume of the oil pan 7 should not be reduced even though the lateral cooling water passage 58 is disposed, and sufficient amount of oil can be accumulated in the oil pan 7.

Furthermore, since the lateral cooling water passage 58 is formed in the passage case 59 which is separated from the bottom surface 7*a* of the oil pan 7, a shape of molding die for the oil pan 7 should not be complicated, and the lateral cooling water passage 58 can easily be disposed without deteriorating the producing performance of the oil pan 7.

Still furthermore, since the upper end of the cooling water supply pipe 69 and the water pressure valve 67 are provided in the passage case 59, the oil pan 7 itself is very simple in shape and can easily be produced. Since the structure around the lateral cooling water passage 58 is simplified, assembling performance can be enhanced.

What is claimed is:

1. A cooling water passage structure of an outboard motor which is equipped with an engine, an engine holder, an oil pan disposed below the engine in a state of the outboard motor being mounted to a hull and a water pump disposed below the oil pan, said cooling water passage structure comprising:

a vertical cooling water passage vertically passing through inside the oil pan and communicated with a side of the engine;

a lateral cooling water passage extending in a lateral direction along a bottom surface of the oil pan;

a cooling water supply pipe extending upward from the water pump and connected to the side of the engine; and a water pressure valve provided for the lateral cooling water passage for controlling a pressure increasing of the cooling water, wherein said lateral cooling water passage has one end communicated with a lower end of the vertical cooling water passage and has another one end to which an upper end of the cooling water supply pipe is connected.

2. A cooling water passage structure of an outboard motor according to claim 1, further comprising a box-shaped passage case having an opened upper end and liquid-tightly secured to the bottom surface of the oil pan from a lower side thereof and an interior of said passage case is formed as the lateral cooling water passage.

3. A cooling water passage structure of an outboard motor according to claim 2, wherein said cooling water supply pipe has an upper end connected to the passage case and said passage case is provided with said water pressure valve.

4. A cooling water passage structure of an outboard motor according to claim 2 wherein a communication recess is formed to the bottom surface of the oil pan so that one end of the lateral cooling water passage is communicated with the lower end of the vertical cooling water passage and the water pressure valve is disposed below the communication recess.

5. A cooling water passage structure of an outboard motor according to claim 1, wherein said vertical cooling water passage is composed of passage sections passing through the oil pan and the engine holder and being aligned together.

6. A cooling water passage structure of an outboard motor according to claim 5, wherein the engine holder and the oil pan are formed with cooling water discharge passages formed integrally for discharging outward the cooling water from the engine.

* * * * *

UNITED STATES PATENT AND TRADEMARK OFFICE

CERTIFICATE OF CORRECTION

PATENT NO. : 6,012,956
DATED : January 11, 2000
INVENTOR(S) : Shuichi Mishima et al.

It is certified that error appears in the above-identified patent and that said Letters Patent is hereby corrected as shown below:

Title page,
Item [57], in the Abstract,
Line 12, before "valve", delete "relief".

Signed and Sealed this

Eleventh Day of September, 2001

*Attest:*

Nicholas P. Godici

*Attesting Officer*

NICHOLAS P. GODICI
*Acting Director of the United States Patent and Trademark Office*